United States Patent [19]

Martin

[11] Patent Number: 4,541,247

[45] Date of Patent: Sep. 17, 1985

[54] STEAM TURBINE GLAND SEAL CONTROL SYSTEM

[75] Inventor: Harry F. Martin, Altamonte Springs, Fla.

[73] Assignee: Westinghouse Electric Corp., Pittsburgh, Pa.

[21] Appl. No.: 617,459

[22] Filed: Jun. 5, 1984

[51] Int. Cl.[4] ..... F01K 13/02

[52] U.S. Cl. ..... 60/660; 60/657; 60/676

[58] Field of Search ..... 60/646, 657, 660, 676, 60/662

[56] References Cited

U.S. PATENT DOCUMENTS 3,062,553 11/1962 Juzi ..... 60/660 X
4,282,708 8/1981 Kuribayashi et al. ..... 60/646 X

FOREIGN PATENT DOCUMENTS 34805 10/1971 Japan ..... 60/657
132001 10/1979 Japan ..... 60/657

*Primary Examiner*—Stephen F. Husar
*Attorney, Agent, or Firm*—Dean Schron

[57] ABSTRACT

A high pressure steam turbine having a sealing gland where the turbine rotor penetrates the casing of the turbine. Under certain conditions the gland is sealed by an auxiliary steam supply, and under other conditions the gland is self sealed by turbine inlet steam. A control system is provided to modify the temperature of the auxiliary steam to be more compatible with the self sealing steam, so as to eliminate thermal shock to the turbine rotor.

7 Claims, 8 Drawing Figures

STEAM TURBINE GLAND SEAL CONTROL SYSTEM

BACKGROUND OF THE INVENTION

1. Field of the Invention

The invention in general relates to steam turbines, and particularly to a system for maintaining proper temperature in the gland sealing system of the turbine.

2. Description of the Prior Art

A steam turbine ordinarily has a shaft, or rotor, resting in bearings and enclosed in one or more casings, referred to as cylinders. At the point where the rotor penetrates the outer cylinders some means is required in order to prevent leakage of air into, or steam from, the cylinders. Members known as glands having labyrinth-type seal rings in conjunction with a gland sealing steam system are provided to perform this function.

During startup or at relatively low load conditions, sealing steam for the glands is provided by a steam supply such as an auxiliary boiler designed for this purpose. Once the turbine is running at higher load levels, the steam for sealing the gland is provided from within the turbine itself such as by exhaust steam, during which condition the system is self-sealing.

Some turbines are designed such that the turbine inlet steam is utilized to self-seal a gland, in which case the steam temperature for sealing is much higher than that provided by an auxiliary system. If the turbine is suddenly tripped, or if the load drops below a predetermined level, sealing switches from self-seal back to the auxiliary system at the much lower temperature. This subjects the rotor to an objectionable thermal shock due to the difference in temperatures between the sealing steam, and thus reduces the life of the rotor. Conversely, during startup conditions sealing steam will switch from the relatively low temperature auxiliary to the relatively higher temperature inlet steam again subjecting the rotor to the objectionable thermal shock.

The present invention provides for an improved gland sealing system which minimizes or eliminates the objectionable thermal shock and therefore increases rotor life.

SUMMARY OF THE INVENTION

The improved steam turbine gland seal control system of the present invention includes a steam line in steam communication with a gland seal of the turbine and a gland seal steam supply is controllably connected to the steam line. Means are provided for measuring the temperature in the steam line, for generating a temperature output signal and a control means responsive to the temperature output signal and a signal indicative of a predetermined operating condition of the turbine functions to modify the temperature of the steam in the steam line.

DESCRIPTION OF THE PREFERRED EMBODIMENTS

Figure 1:
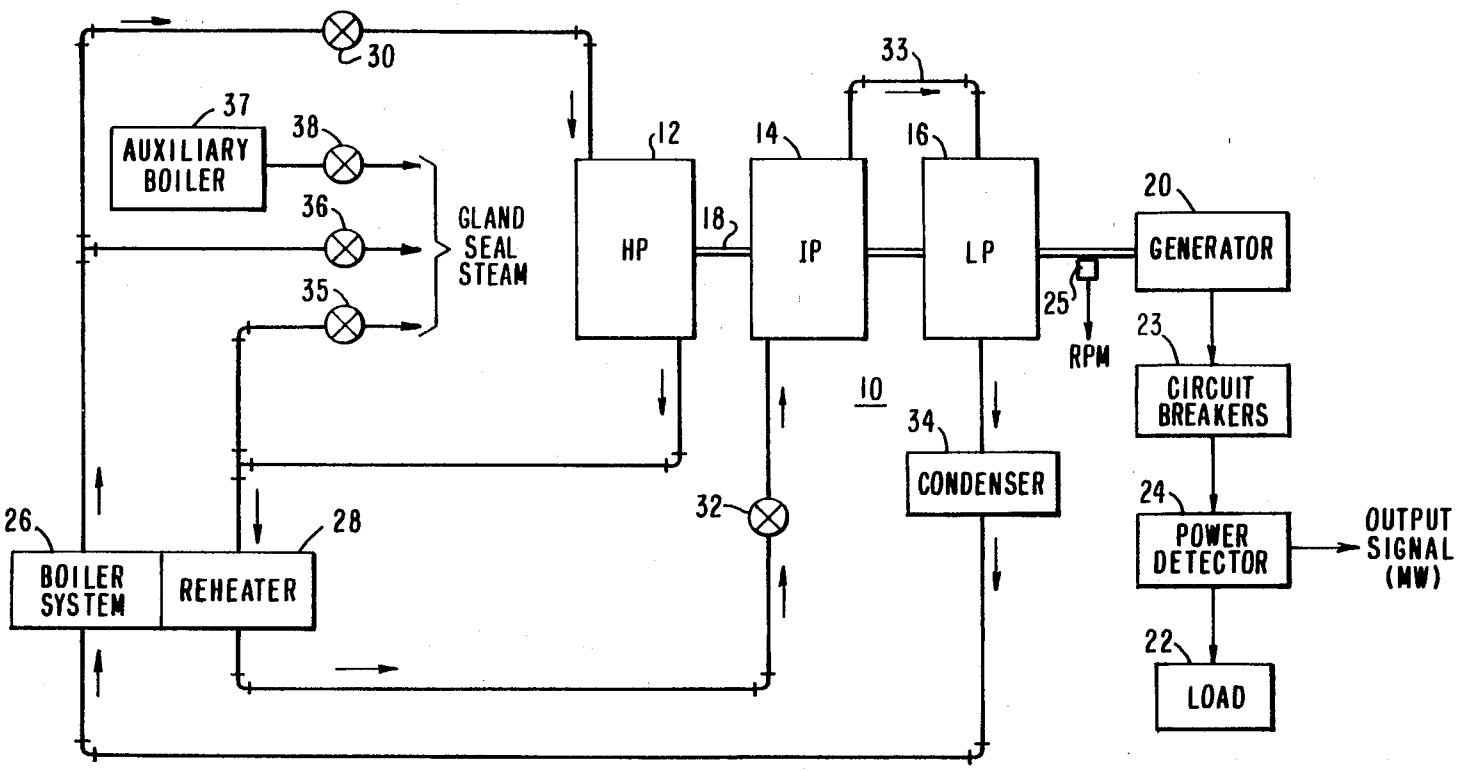
FIG. 1 is a simplified block diagram of a steam turbine generator system.

FIG. 1 illustrates a typical steam turbine system for a power plant and includes a steam turbine arrangement 10 having a plurality of turbines in the form of high pressure turbine 12, intermediate pressure turbine 14 and low pressure turbine 16. The turbines are coupled to a common shaft 18 to drive an electrical generator 20 which supplies power to a load 22, after main circuit breakers 23 are closed.

A power detector 24 is operable to provide an output signal (MW) indicative of load and a speed transducer system 25 is operable to provide an output signal (RPM) indicative of turbine speed.

Steam to drive the turbines is supplied from a boiler system 26 which includes a reheater section 28. Boiler steam is provided to the high pressure turbine 12 through input valving 30 and steam exiting the high pressure turbine 12 is reheated in the reheater section 28 and provided to intermediate pressure turbine 14 through valving 32. Steam exiting the intermediate pressure turbine 14 is provided by way of crossover piping 33 to the low pressure turbine 16 from which the steam is exhausted into a conventional condenser 34 and thereafter circulated back to the boiler system.

As will be described, the turbines include glands which must be sealed under certain operating conditions by means of gland seal steam. The steam supply for this can be one of a number of sources one of which is the steam input to reheater 28, such steam also being known as the cold reheat steam, and controllably supplied by valve 35. The main steam, controlled by valve 36, may also be used as a source as well as steam from an auxiliary boiler 37 controllably supplied by valve 38.

Figure 2B:
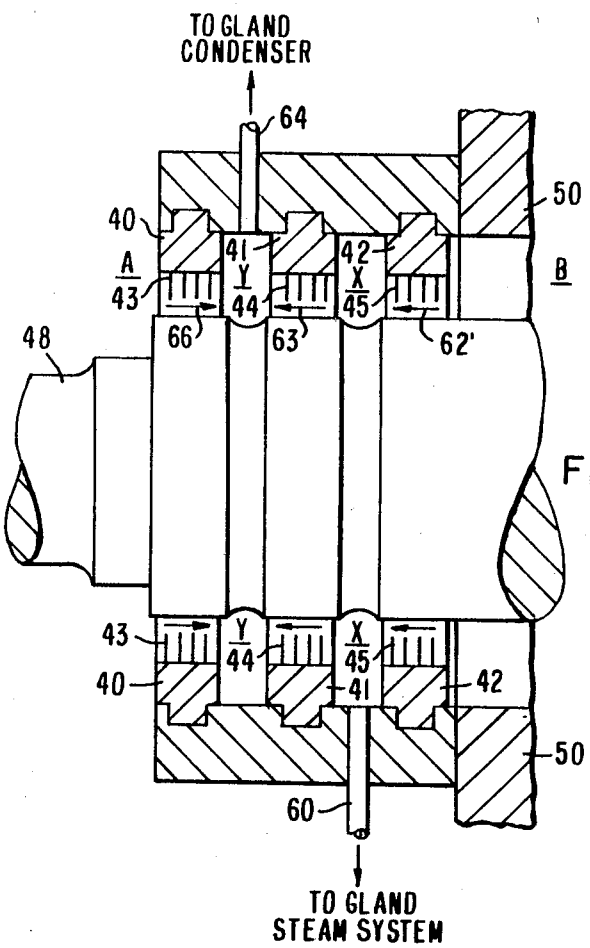
FIGS. 2A and 2B are sectional views diagrammatically illustrating a gland sealing arrangement.
Figure 2A:
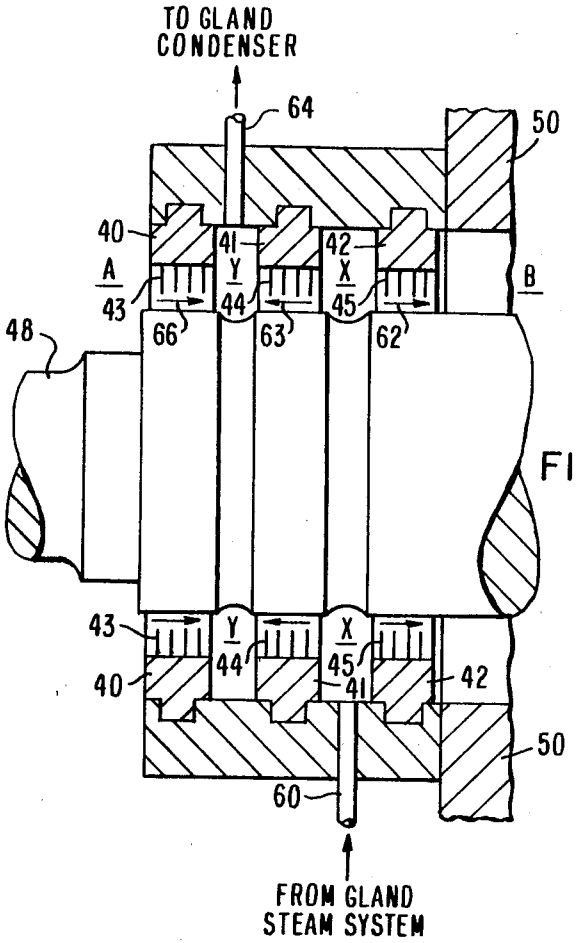

A typical rotor gland seal is illustrated in simplified form in FIG. 2A. The gland seal arrangement includes a plurality of gland seal rings 40 to 42 each containing a respective number of seal strips 43 to 45 which encircle the rotor 48 at the ends of the outer cylinder 50 and which clear the rotor surface just enough to prevent contact during operation.

The atmospheric environment outside of the turbine is represented by letter A while B represents the turbine interior. The gland sealing arrangement defines two interior chambers X and Y each encircling the rotor 48. During startup or at relatively low loads, the pressure at B is below the atmospheric pressure at A and sealing steam is supplied to chamber X via steam line 60. The sealing steam thus supplied to chamber X leaks past the seals into the turbine, as indicated by arrow 62, and into chamber Y as indicated by arrow 63. Chamber Y is maintained at a pressure slightly below atmospheric pressure by a connection to a gland condenser via line 64. Since chamber Y is at subatmospheric pressure, air leaks past the outer seal from the atmosphere to chamber Y, as indicated by arrow 66.

When the pressure at B exceeds the pressure of chamber X, a reversal in flow occurs across the inner seal ring, as indicated by arrow 62' in FIG. 2B. With increasing pressure, flow increases such that the gland becomes self-sealing and steam is discharged from chamber X back to the gland's steam system where it will be supplied to the glands of the low pressure turbine and any excess steam will be provided to the system condenser. The pressure at B may be the pressure at the turbine exhaust and, for a single flow high pressure turbine, may be the pressure at the high pressure inlet end. (This would be maintained at the same pressure as the high pressure exhaust.)

Figure 3:
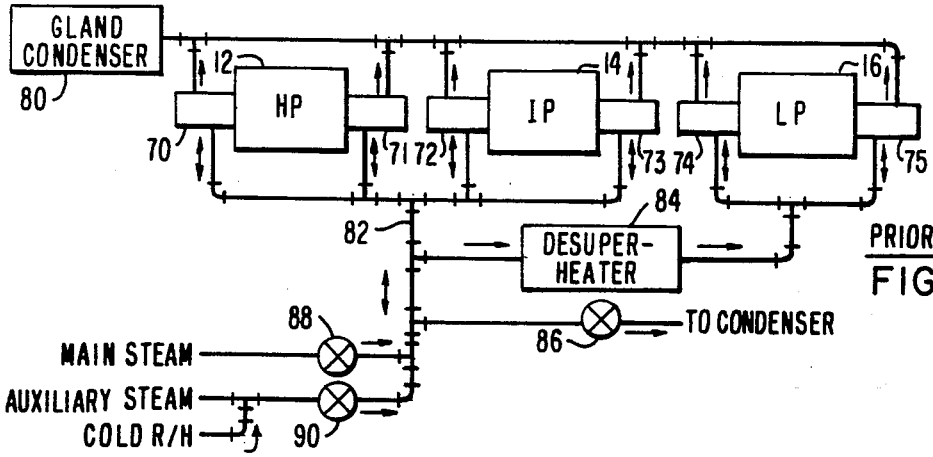
PRIOR ART FIG. 3
FIG. 3 is a block diagram of a gland sealing steam system of the prior art.

A typical prior art gland steam system is illustrated in FIG. 3. High pressure turbine 12 includes on respective ends thereof glands 70 and 71, intermediate pressure turbine 14 includes glands 72 and 73 and low pressure turbine 16 includes glands 74 and 75. The glands of all three turbines are commonly connected to a gland condenser 80 which accepts leakage steam and air and maintains one chamber (Y) of the gland seal at subatmospheric pressure. The glands of high and intermediate pressure turbines 12 and 14 are additionally commonly connected to a steam header 82 the connection being made to chamber X such as by steam line 60 illustrated in FIGS. 2A and 2B.

Discharge from chamber X is utilized for sealing the glands of low pressure turbine 16, after being cooled to a compatible operating temperature by means of a desuperheater 84. Any excess steam flows to the main condenser via a valve 86 which serves to maintain the proper pressure in the header.

The steam supply for sealing the glands may include main steam which is controllably provided to header 82 by means of a valve 88 as well as auxiliary steam from an auxiliary boiler or cold reheat steam controllably provided to header 82 by means of valve 90.

If the high pressure turbine 12 is of a single flow design wherein gland 70 is self-sealed by inlet steam, a problem arises in potential thermal shock to the turbine rotor due to the significant difference in temperature between the inlet steam and the gland supply steam. To illustrate this, reference is made to FIG. 4 wherein the dot-dash curve 100 represents turbine load, plotted on the right vertical scale. Curve 100 represents a decreasing load from 100% to about 10 percent at time $t_1$ and during which decrease, gland 70 is self-sealing by the inlet steam; steam temperature is represented by solid curve 102. The temperature is plotted on the leftmost vertical axis and it is seen that the temperature of gland sealing steam is in the 800° to 900° F. (426.7°–482.2° C.) range, provided by the inlet steam. At time $t_1$ at the 10% load figure the self sealing condition switches to the gland steam supply system such as provided by the auxiliary boiler, which, from practical considerations, provides steam at a maximum temperature in the range of 500° to 600° F. (260°–315.5° C.), the abrupt change showing up as a step function at time $t_1$. The abrupt change in temperature is a thermal shock to the rotor and will potentially reduce rotor life. The present invention smooths out this thermal shock by gradually reducing sealing steam temperature from the upper range to the lower range, and is illustrated by the dotted curve 104 which portrays a gradual reduction in temperature from time $t_1$ to time $t_2$.

Figure 5:
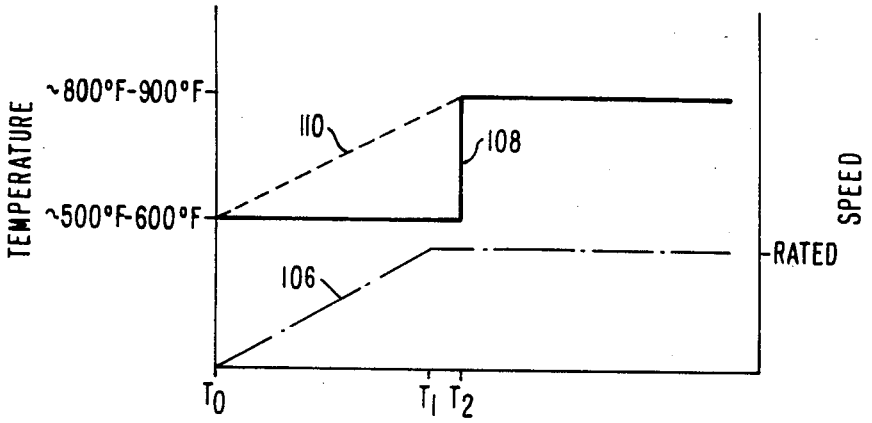

A similar problem exists when the turbine comes on line. For example, the dot-dash curve 106 of FIG. 5 represents increasing turbine speed up to the rated speed, plotted on the rightmost vertical scale. After having achieved rated speed from time $T_0$ to $T_1$ the unit thereafter will pick up load at time $T_2$. Up until time $T_2$ the gland is being sealed by auxiliary steam in the lower temperature range as indicated by solid curve 108. At time $T_2$ self-sealing occurs with the higher temperature inlet steam resulting in a step function of temperature at time $T_2$. The present invention eliminates this step function shock by gradually increasing the sealing steam temperature from $T_0$ to $T_2$, as illustrated by the dotted curve 110.

Figure 6:
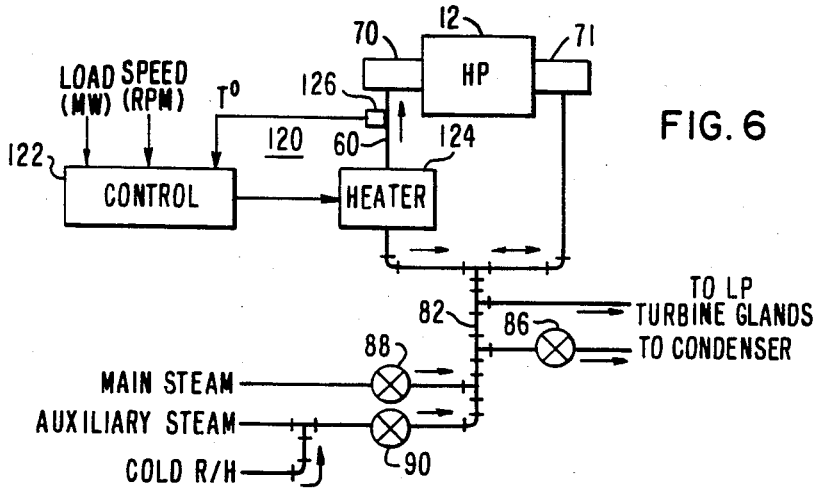
FIG. 6 is one embodiment of the present invention as applied to a high pressure turbine.

One embodiment of the present invention which accomplishes the elimination of thermal shock is illustrated in FIG. 6 which reproduces portions of FIG. 3. For convenience the intermediate and low pressure turbines 14 and 16 as well as the gland condenser system are not illustrated.

The arrangement of FIG. 6 includes a control means 120 having a control circuit 122 for regulating the heat provided by heater 124 such as an electric heater in heat transfer relationship with steam pipe 60. A transducer 126 associated with steam pipe 60 provides an output signal indicative of the steam temperature within the pipe and provides this indication to the control circuit 122 which also receives signals indicative of speed (RPM) and load (MW).

Figure 4:
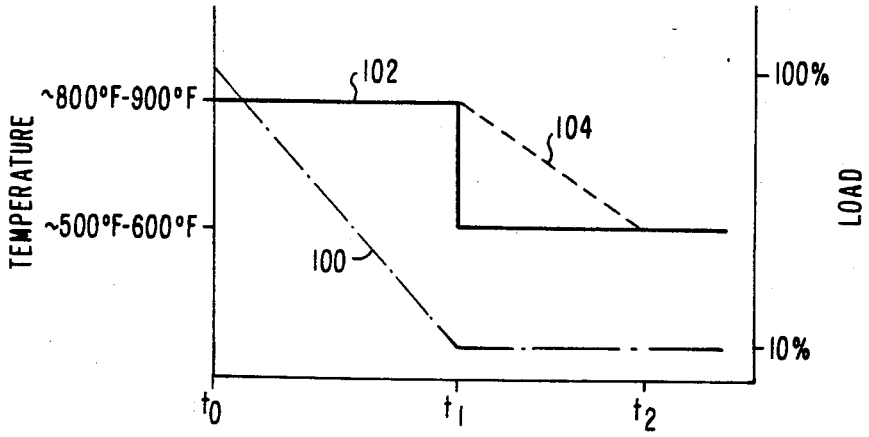
FIGS. 4 and 5 are curves illustrating improved sealing operation provided by the present invention.

When the unit is on line, the control circuit 122 is able to sense decreasing load such that when it attains a predetermined value, such as the 10% level, the control system will be operative to initially impart a higher than normal temperature to the auxiliary steam for sealing and to gradually decrease the heat energy supplied in accordance with curve 104 of FIG. 4.

Conversely, when coming on line, the temperature and speed indications will cause the control arrangement to gradually increase the heat of the auxiliary steam used to seal gland 70 until it attains the temperature of inlet steam which will be applied, in accordance with curve 110 of FIG. 5.

Although a similar control arrangement can be applied to the steam line for gland 71, it will generally be unnecessary since the self-sealing steam for that gland is the turbine exhaust steam at a lower temperature more compatible with the auxiliary steam, thereby resulting in a less severe and more acceptable thermal shock.

Figure 7:
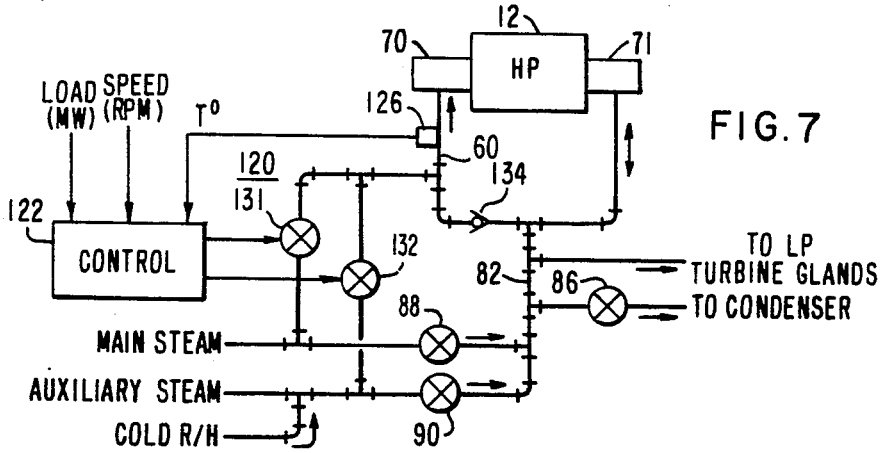
FIG. 7 illustrates another embodiment of the present invention.

FIG. 7 illustrates an alternate embodiment wherein sealing steam temperature is controlled by steam mixing as opposed to electric heating. Higher temperature main steam, just prior to valve 88, can be supplied to steam line 60 by means of a valve 131 and the lower temperature auxiliary steam, from ahead of valve 90 can be supplied by means of valve 132. The opening and closing of these valves 131 and 132 is governed by the control circuit 122 which in response to the temperature indication provided by transducer 126 and load or speed indication will regulate these valves to add or reduce heat, as the case may be, as previously described. In the steam mixing embodiment, a nonreturn or one-way valve 134 is included in the steam line 60.

Accordingly an arrangement has been described for reducing stress in the steam turbine gland area and prolonging rotor life by eliminating thermal shock due to the different temperatures in sealing steam when switching from or to a self sealing condition.

I claim:

1. A steam turbine gland seal control system for a steam turbine driving an electrical generator which supplies power to a load after main circuit breakers are closed, and in which the gland is self-sealing by steam in the turbine after said closing, comprising:

(A) means for measuring turbine speed for providing an output signal indicative of turbine speed;

(B) means for measuring turbine load for providing an output signal indicative of load, when said circuit breakers are closed;

(C) a steam line in steam communication with said gland seal;

(D) a gland seal steam supply controllably connected to said steam line;

(E) means for measuring the temperature of steam within said steam line for providing a temperature output signal;

(F) a control circuit responsive to (a) said temperature output signal and (b) one of said speed or load output signals, depending upon whether said turbine is on-line, to provide an output control signal which continuously varies as said speed or load output signals vary; and (G) heating means responsive to said output control signal to modify the temperature of steam in said steam line.

2. Apparatus according to claim 1 wherein said heating means includes:

(A) a heater in heat transfer relationship with said steam line and responsive to said control signal to modify the steam temperature in said steam line.

3. Apparatus according to claim 2 wherein:

(A) said heater is an electric heater.

4. Apparatus according to claim 1 wherein:

(A) said turbine is a high pressure single flow turbine, and (B) said gland is disposed at the high pressure inlet end of said turbine.

5. Apparatus according to claim 1 which includes:

(A) valving means connecting said steam supply to said steam line and responsive to said output control signal to allow mixing of steam from said supply with steam in said steam line.

6. Apparatus according to claim 5 wherein:

(A) said steam supply includes at least first and second sources;

(B) said valving means includes first and second valves for respectively controlling steam flow from said first and second sources; and (C) said control circuit provides first and second output control signal for respectively controlling said first and second valves.

7. Apparatus according to claim 5 wherein:

(A) said turbine is a high pressure single flow turbine, and (B) said gland is disposed at the high pressure inlet end of said turbine.

* * * * *